United States Patent [19]

Narushima et al.

[11] Patent Number: 4,634,304

[45] Date of Patent: Jan. 6, 1987

[54] PRINTER

[75] Inventors: Tsugio Narushima; Tsutomu Arai; Yasuo Doumoto, all of Shizuoka, Japan

[73] Assignee: Tokyo Electric Co., Ltd., Tokyo, Japan

[21] Appl. No.: 648,087

[22] Filed: Sep. 7, 1984

[30] Foreign Application Priority Data

Sep. 12, 1983 [JP] Japan ..... 58-168070
Sep. 14, 1983 [JP] Japan ..... 58-170135
Sep. 14, 1983 [JP] Japan ..... 58-142698[U]

[51] Int. Cl.[4] ..... B41J 29/16; B41J 29/02; B41J 15/04

[52] U.S. Cl. ..... 400/691; 400/88; 400/613.2

[58] Field of Search ..... 400/613.2, 408, 691, 400/692, 32, 693, 82, 88, 613; 271/171, 149, 223, 224

[56] References Cited

U.S. PATENT DOCUMENTS 1,918,665 7/1933 Read ..... 400/32
3,884,342 5/1975 Mulholland ..... 400/693
3,910,396 10/1975 Eischen et al. ..... 400/82
4,026,402 5/1977 Byrd ..... 400/124
4,039,181 8/1977 Prewer ..... 271/149
4,076,160 2/1978 Azzalin et al. ..... 400/613.2
4,079,826 3/1978 Shaw ..... 400/693
4,175,878 11/1979 Wing ..... 400/693
4,266,880 5/1981 Buchanan ..... 400/550
4,314,769 2/1982 James, III ..... 400/144.2
4,318,625 3/1982 Survant ..... 400/322
4,319,850 3/1982 Rello et al. ..... 400/247
4,353,657 10/1982 Schaefer ..... 400/208
4,446,790 5/1984 Konkel et al. ..... 101/93.14

FOREIGN PATENT DOCUMENTS 90388 7/1980 Japan ..... 400/613

OTHER PUBLICATIONS

Escobar, "Roll Paper Attachment . . . Printer", IBM Technical Disclosure Bulletin, vol. 22, No. 10, p. 4360, 3/80.

*Primary Examiner*—William Pieprz
*Attorney, Agent, or Firm*—Oblon, Fisher, Spivak, McClelland, & Maier

[57] ABSTRACT

A printer according to the present invention having a vertical type body, so as to remarkably reduce a bottom surface area of the printer. A paper feed mechanism, a platen and a carrier are arranged on a front side of the body, so as to readily set a paper and exchange a printing ribbon. A power source block which forms the heaviest part including a transformer, etc. is arranged at a lower portion on a rear side of the body by utilizing a dead space on the rear side, so as to enhance stability. Further, a handle is provided at an upper portion of the vertical body, so as to allow for easy transport of the body.

2 Claims, 11 Drawing Figures

PRINTER

BACKGROUND OF THE INVENTION

1. Field of the Invention

This invention relates to a printer which is allowed to conduct a printing operation by moving a printing head in a direction perpendicular to a paper feed direction.

2. Description of the Prior Art

Recently, there has been increased a case that a printing device as well as an output device and an input device such as a display unit and a floppy disc drive unit is placed on the same table as with the spread of Office Automation equipment. However, insofar as a conventional printing device is of flat type and is wide in a bottom surface area thereof, it is inconvenient to be handled or carried with a single hand upon modification of layout of the equipment or carriage of the printing device.

SUMMARY OF THE INVENTION

A first object of the present invention is to reduce a bottom surface area of the printer when in place.

A second object of the present invention is to provide a stable operating condition irrespective of the fact that the body is of a vertical type.

A third object of the present invention is to effectively utilize an internal space of the body.

A fourth object of the present invention is to easily mount and dismount a paper and a ribbon.

A fifth object of the present invention is to easily carry the printer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
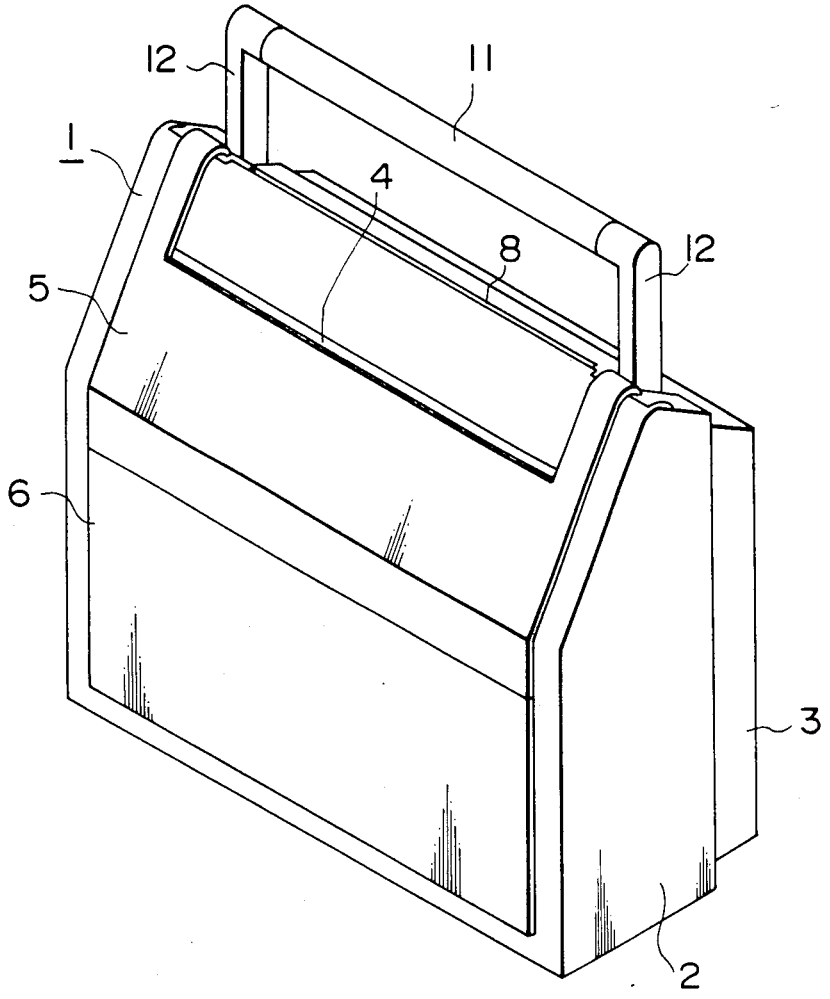
FIG. 1 is a perspective view showing a first preferred embodiment of the present invention.
Figure 2:
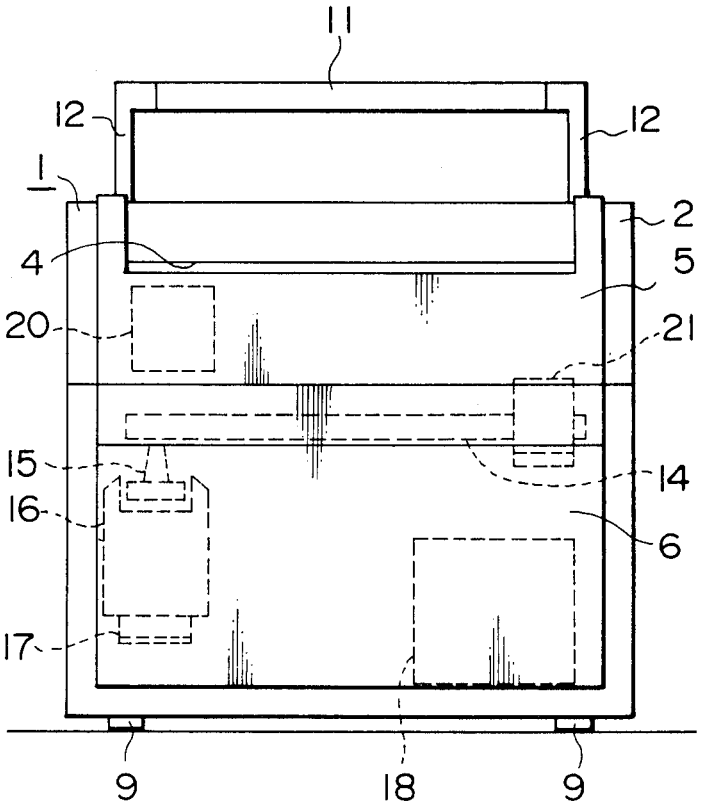
FIG. 2 is a front elevational view of FIG. 1.
Figure 3:
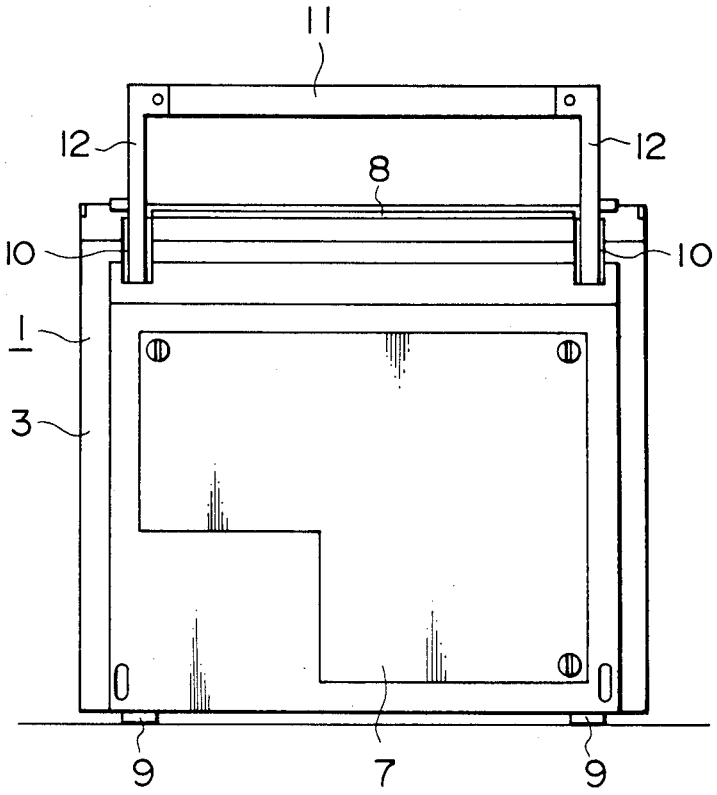
FIG. 3 is a rear elevational view of FIG. 1.
Figure 4:
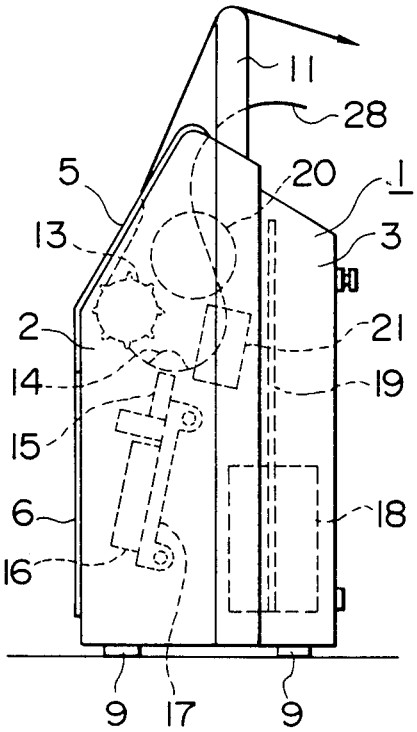
FIG. 4 is a side elevationl view as viewed from a right-hand side.
Figure 5:
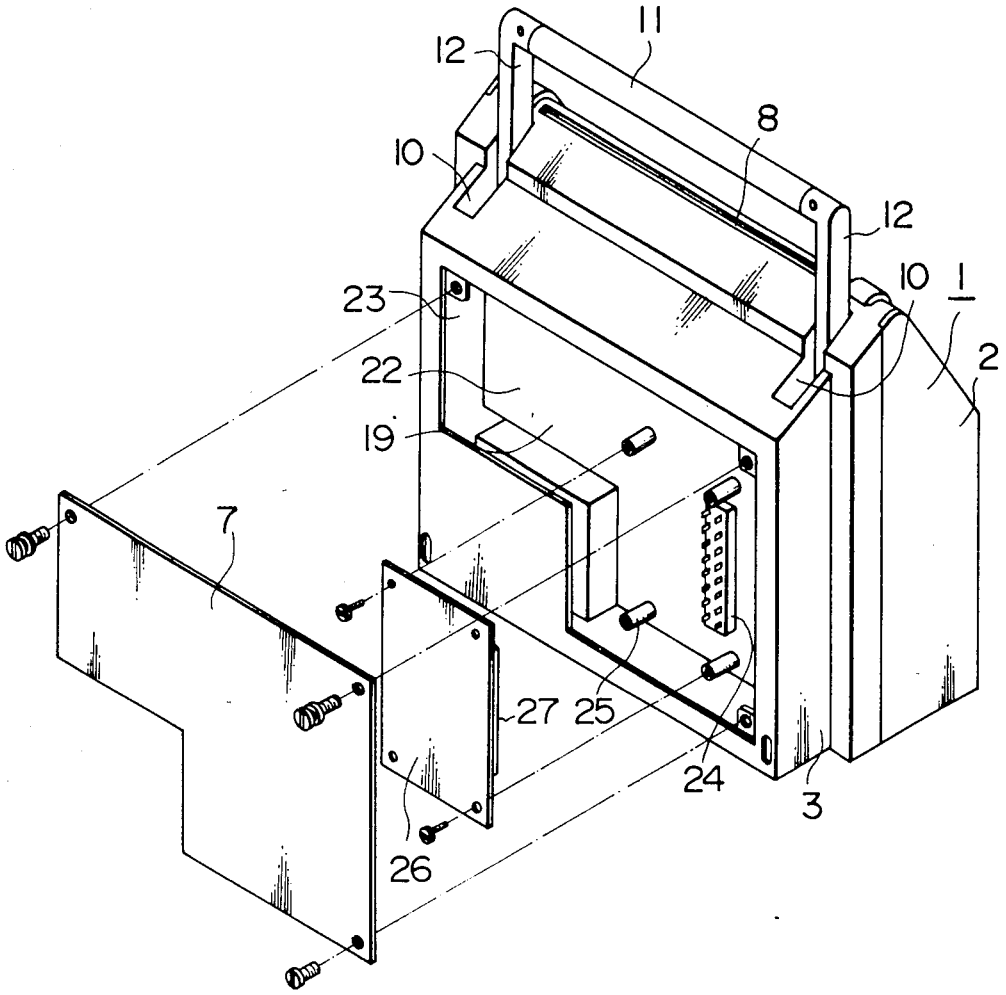
FIG. 5 is an exploded view in perspective, showing installation of a sub PC plate.
Figure 6:
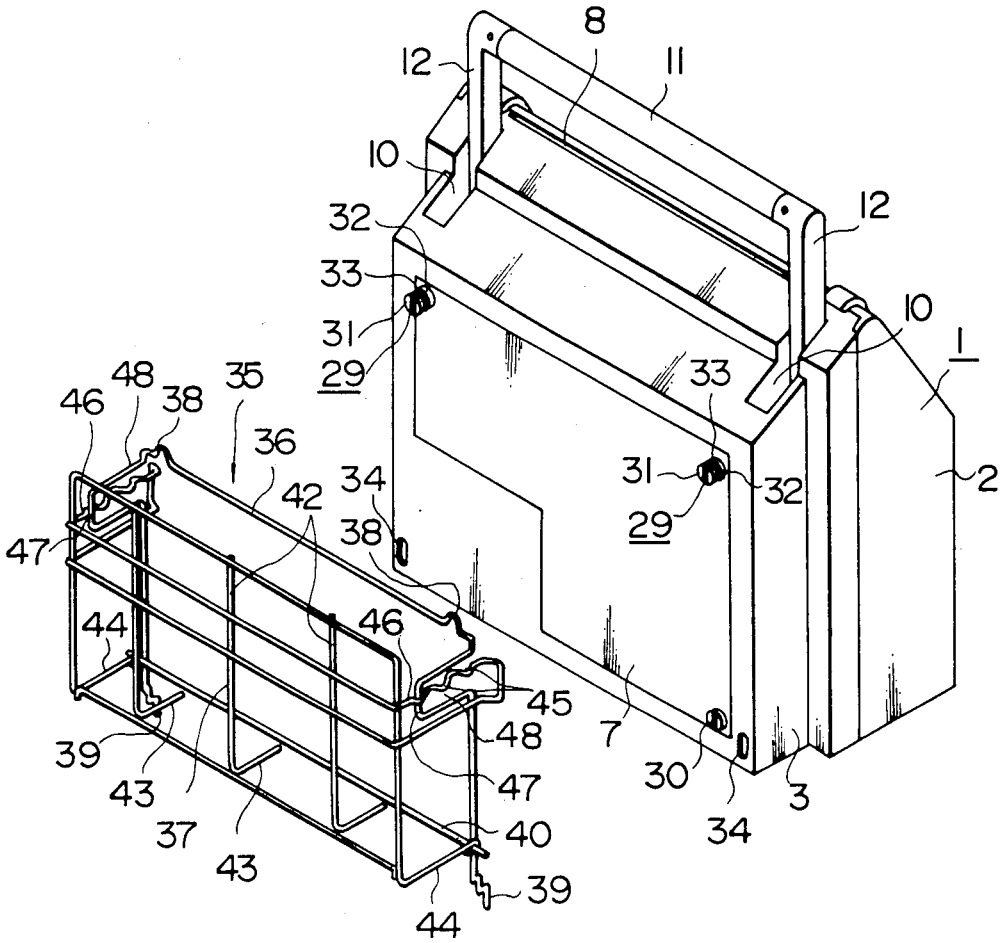
FIG. 6 is a perspective view showing a second preferred embodiment of the present invention which illustrates installation of a paper holder from a rear side.

Referring first to FIGS. 1 to 5 which show a first preferred embodiment of the present invention, reference numeral 1 designates a unitary body or case. The body 1 is constituted of a combined front case 2 and rear case 3. A printer cover 5 and a carrier cover 6 covering an opening 4 of the front case 2 except its upper part are detachably mounted on a front side of the body 1, and a PC plate cover 7 is screwed on a rear side thereof. A laterally elongated insert hole 8 is formed at an upper edge of a connected portion between the front case 2 and the rear case 3. The body 1 is designed in such a manner that the height is larger than the depth, and the area of the bottom surface is smaller than that of the front surface. Further, legs 9 are provided at four corners of the bottom surface. Recesses 10 are formed at the upper portion of the rear case 3, and arms 12 on both sides of a handle 11 are rotatably engaged with the recesses 10.

Arranged in a space on the front side of the body 1 are sprockets 13 for feeding a paper, a platen 14, a dot printer head 15 as a printing unit disposed under and opposite to the platen 14, and a carrier 17 for holding a ribbon cassette 16. On the other hand, a power source block 18 having a transformer is fixed at the right-hand lower portion in a space on the rear side of the body 1 by utilizing a dead space on the rear side of the carrier 17, and a PC plate 19 is mounted on the rear side of the body 1. A paper feed motor 20 for driving the sprockets 13 is mounted at the left-hand upper portion in a central area of the depth, and a carrier motor 21 for reciprocating the carrier 17 is mounted on the right-hand side in a central area of the depth and the height.

An electronic circuit element mount surface 22 of the PC plate 19 is opposed to an opening surface 23 formed at the rear case 3 of the body 1, and the mount surface 22 is provided with a connector 24 and a plurality of screw seats 25 for receiving screws. An optional sub PC plate 26 to be selectively screwed into the screw seats 25 is provided with a connector 27 to be connected to the connector 24.

In operation, the printer cover 5 is removed, and a paper 28 inserted through the insert hole 8 is passed under the lower surface of the platen 14, and is wound around the sprockets 13. Then, the printer cover 5 is closed to introduce an end of the paper 28 from the upper edge of the opening 4. Under this condition, rotation of the paper feed motor 20 is transmitted to the sprockets 13 to intermittently feed the paper 28 in its longitudinal direction, and the carrier 17 is reciprocated along the platen 14 by the carrier motor 21 to carry out a printing operation. In this case, since the body 1 is of a vertical type, a bottom surface area of the body 1 is remarkably small and accordingly only a reduced space is sufficient even in the case that the body 1 is put on a table together with other input/output devices.

Further, since the sprockets 13, the platen 14 and the carrier 17 are arranged on the front side of the body 1, setting of the paper 28 and exchanging of the ribbon cassette 16 may be easily carried out. As the power source block 18 occupying the most heavy part is arranged at the lower portion on the rear side of the body 1, the body 1 is stable and there is no possibility of such falling down when the printer cover 5 and the carrier cover 6 are removed, irrespective of the fact that the body 1 is of a vertical type. Further, it is possible to remove the PC plate cover 7 in order to check the PC plate 19, or if required, to mount the sub PC plate 26 to the screw seats 25 so as to connect the sub PC plate 26 with the PC plate 19 by connecting the connectors 24 and 27.

Further, since the body 1 is provided with the handle 11 as well as being of a vertical type, it may be grasped with a single hand and carried about.

Referring next to FIGS. 6 to 9 which show a second preferred embodiment of the present invention, wherein identical parts as with the previous embodiment are designated by identical reference numerals, and relevant explanations thereof are omitted (also similar as to a third preferred embodiment), reference numerals 29 and 30 designate screws for fixing the PC plate cover 7, and the upper two screws 29 are formed with small diametrical portions 33 between head portions 31 to be operated by a screw driver and flanges 32 for pushing the PC plate cover 7. There are formed elongated holes 34 on both sides at the lower portions of rear cover 3. Thus, a paper holder 35 is designed to be mounted to the rear case 3. The paper holder 35 is comprised of a mount member 36 to be mounted to a rear surface of the rear case 3 and a holder body 37. The mount member 36 is formed by bending a wire, and is comprised of bent portions 38 to be hung on the small diametrical portions 33 of the screws 29, bent portions 39 to be inserted into the elongated holes 34 of the rear case 3, and a bar 40 horizontally extending at the lower portion of the paper holder 35. The holder body 37 is formed by bending a plurality of wires in a lattice-shape to connect each other, and is comprised of a rear support 42 for supporting one surface of a paper 41 folded in a zig-zag way along a perforated line, a bottom support 43 for supporting an edge of the paper 41, and a connecting bar 44 rotatably supported to the bar 40. Further, arms 46 having sawtooth wave portions 45 are formed on both sides of the holder body 37, and arms 47 adapted to resiliently engage with a concave portion of the wave portions 45 on an inner side of the arms 46 are formed on both sides of the mount member 36. Thus, two pairs of the arms 46 and 47 form an adjusting means 48 for adjusting a spacing between the rear surface of the body 1 and the rear support 42 of the paper holder 35.

Figure 7:
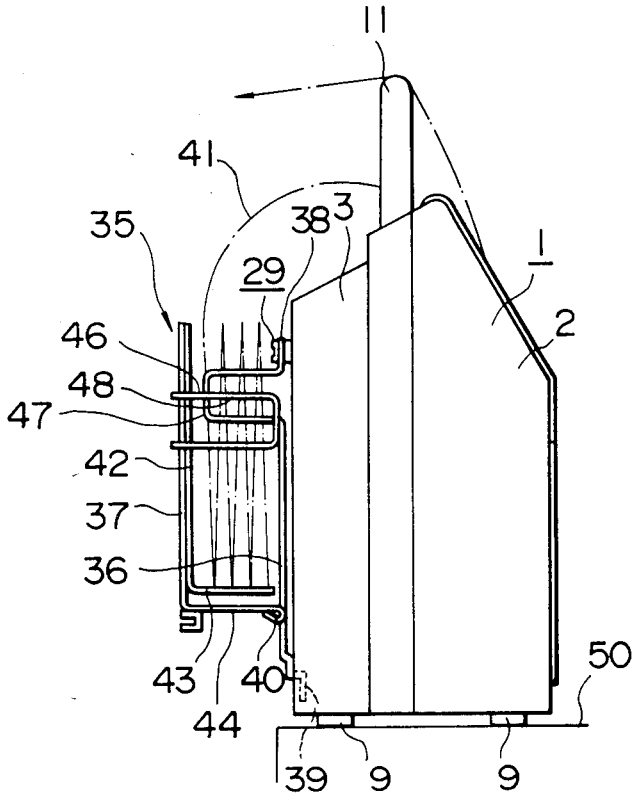
FIGS. 7 to 9 are side elevational views showing various modes of use of the paper holder.
Figure 8:
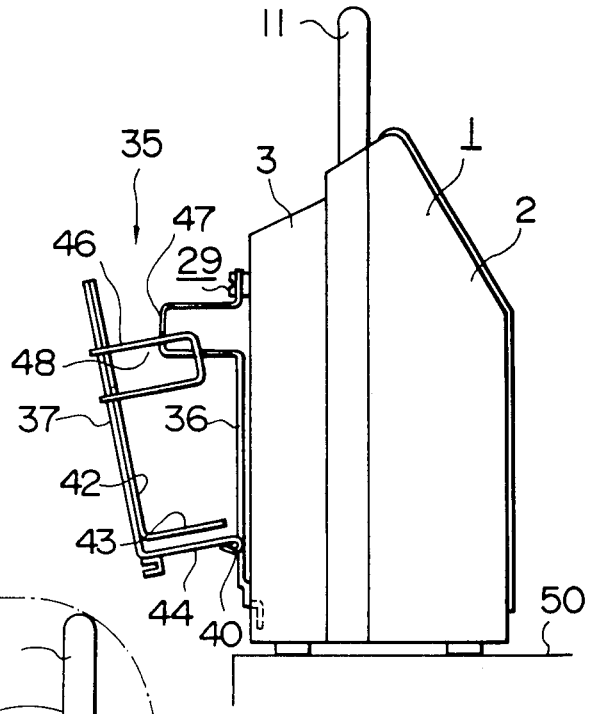
Figure 9:
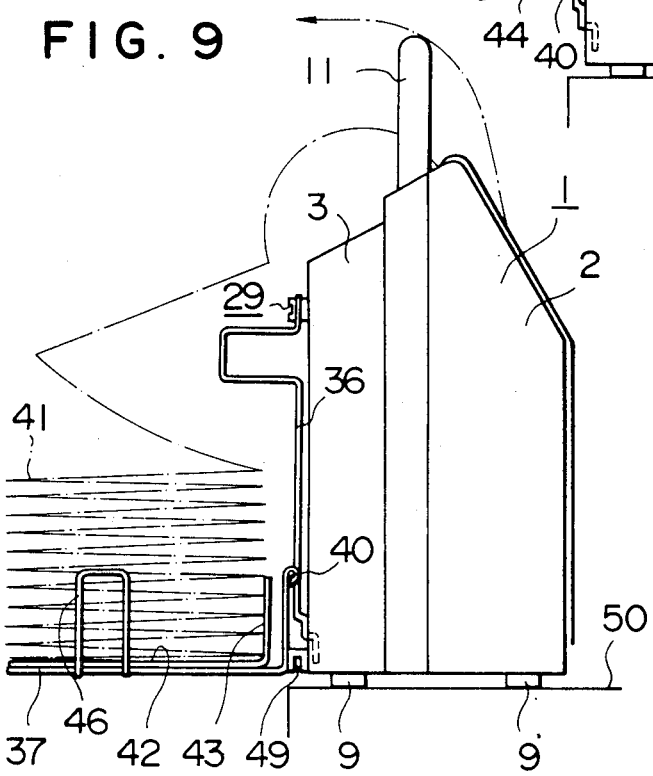

In operation, the paper 41 is vertically set in the paper holder 35 as shown in FIG. 7, and then the paper 41 is inserted through the insert hole 8. Then, the printer cover 5 is removed to pass the paper 41 under the platen 14 and wind the same around the sprockets 13, thereafter introducing the paper 41 out of the upper edge of the opening 4 and closing the printer cover 5. The ribbon cassette 16 is mounted to the carrier 17 by opening the carrier cover 6. Under this condition, the carrier 17 is moved to carry out printing operation with the paper 41 fed by the sprockets 13. The paper 41 after being printed is smoothly fed out under a condition of being supported by the handle 11. Thusly, a printing operation is carried out, while as the body 1 is of vertical type, an area occupied by the body 1 on a table 50 is remarkably reduced. Further, as the paper 41 is vertically held in the paper holder 35, a space occupied by the paper 41 on the table 50 is also reduced. The paper holder 35 may externally protruded from the table 50, while the body 1 only is placed on the table 50, thus effectively utilizing space. In case of a large amount of the paper 41, the holder body 37 is rearwardly drawn to engage the arms 47 with an arbitrary concave portion of the wave portions 45 as shown in FIG. 8. In case of a further large amount of the paper 41 being utilized, the arms 46 and 47 are separated from each other to rearwardly rotate the holder body 37 about the bar 40 and fall down same as shown in FIG. 9. In this case, as the holder body 37 is provided with a stopper 49 to be abutted against the rear case 3, the rotational range of the holder body 37 is limited, so that the holder body 37 may be positioned outside of the table 50.

Figure 10:
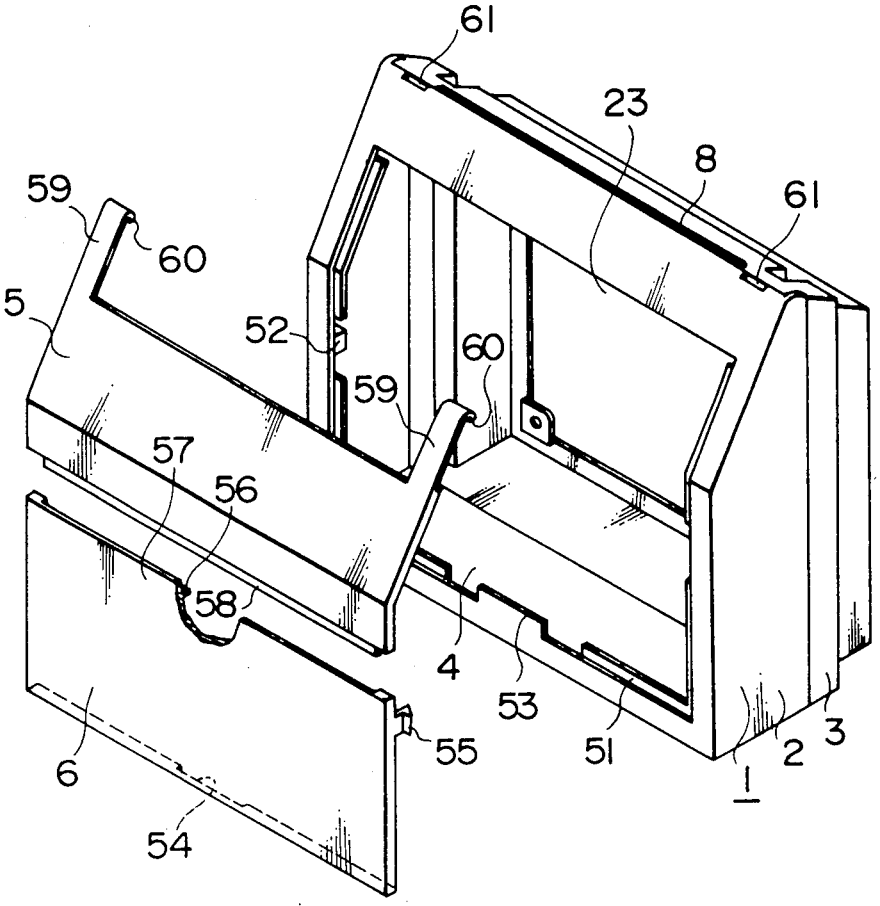
FIG. 10 is a partially exploded view in perspective, showing installation of a printer cover and a carrier cover, of a third preferred embodiment according to the present invention.
Figure 11:
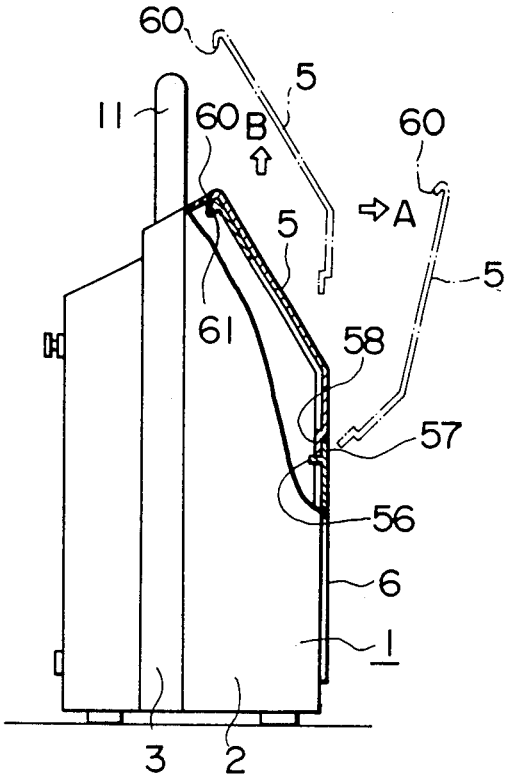
FIG. 11 is a side elevational view of FIG. 10, partially broken away.

Referring next to FIGS. 10 and 11 which show a third preferred embodiment of the present invention, the body 1 is formed by combination of the front case 2 and the rear case 3, both being made of elastic synthetic resin. As shown in FIG. 10, an opening 4 is formed on the front surface of the front case 2, while an opening 23 is also formed on the rear case 3. There are formed a receiving member 51 for supporting the printer cover 5 or the carrier cover 6 at the edge of the front opening 4, a pair of projections on both sides of the front opening 4, and a tongue 53 at the lower edge of the front opening 4. The carrier cover 6 covering a lower half portion of the opening 4 is made of elastic synthetic resin, and is formed with a notch 54 to be engaged with the tongue 53 at the lower edge thereof, a pair of pawls 55 to be resiliently engaged with the projections 52 at both side edges thereof, and a shoulder 56 and an abutting portion 57 at the upper edge thereof. The printer cover 5 covering the upper half portion of the opening 4 is also made of elastic synthetic resin, and is formed with a wide tongue 58 to be supported on the shoulder 56 of the carrier cover 6 and pushed by the abutting portion 57 from outside. Further, the printer cover 5 is formed with a pair of arms 59 upwardly extending on both sides thereof, and the arms 59 are formed with respective projected portions 60 as a first engagement member, which are sectionally semi-circular, at the upper edges thereof. On the other hand, a pair of sectionally semi-circular recessed portions 61 as a second engagement member are formed at the upper portion of the front case 2. The carrier cover 6 is retained by engagement of the notch 54 with the tongue 53, and engagement of the pawls 55 with the projections 52, while the printer cover 5 is retained by abutment of the tongue 58 against the inner surface of the abutting portion 57, and resilient engagement of the projected portions 60 with the recessed portions 61.

In operation, when the PC plate 19 is to be checked, the PC plate cover 7 is merely required to be removed, so that a circuit of the PC plate 19 may be readily exposed to the opening 23. In case of maintenance of the dot printer head 15 or attachment of the ribbon cassette 16, the pawls 55 of the carrier cover 6 are disengaged from the projections 52, and the notch 54 is disengaged from the tongue 53. In setting the paper 28, as is shown in FIG. 11, the printer cover 5 is drawn to the front side (in the direction as depicted by an arrow A), and is rotated about the lower edge thereof to disengage the recessed portions 61 from the projected portions 60, thereafter upwardly pulling the lower edge of the printer cover 5 from the inner surface of the abutting portion 57. In another way, the printer cover 5 is upwardly pushed (in the direction as depicted by an arrow B) to disengage the projected portions 60 from the recessed portions 61 which upper side has now been opened, and then the lower edge of the printer cover 5 is separated from the shoulder 56 and the abutting portion 57. The printer cover 5 is most frequently mounted or removed every time the paper 28 is set. However, as is above described, the printer cover 5 may be removed toward the front side or toward the upper side, and therefore an operator needs not pay attention to the direction in which the printer cover 5 is to be removed, thereby simplifying the operation.

While the invention has been described with reference to specific embodiments, the description is illustrative and is not be construed as limiting the scope of the invention. Various modifications and changes may occur to those skilled in the art without departing from the spirit and scope of the invention as defined by the appended claims.

What is claimed is:

1. A printer comprising:

a vertical body having a height thereof greater than a depth thereof and having a bottom surface area and a side surface area thereof smaller than a front surface area thereof;

means for feeding paper which is arranged at an upper portion in a space on the front side of said case and which further comprises a paper feed motor;

a platen arranged at an intermediate portion in a space on the front side of said case;

carrier means including a carrier arranged at a lower portion in a space on the front side of said case and which includes a carrier motor for driving said carrier, wherein said carrier means comprises means for printing said paper;

a power source block arranged at a lower portion in a space on a rear side of said case;

a cover detachably mounted on said case so as to cover said paper feed motor, said means for feeding paper and said carrier; and a handle mounted on the upper portion of said case and which includes means for guiding said paper out of said body after being printed.

2. The printer as defined in claim 1, wherein said handle is rotatable relative to said case and is adapted to stop at a predetermined position.

* * * * *